US006075430A

United States Patent [19]

Lindqvist

[11] Patent Number: 6,075,430

[45] Date of Patent: Jun. 13, 2000

[54] INDUCTIVE COMPONENT WITH WOUND CORE

[75] Inventor: Arne Bengt Lindqvist, Huddinge, Sweden

[73] Assignee: Telefonaktiebolaget LM Ericsson, Stockholm, Sweden

[21] Appl. No.: 09/068,773

[22] PCT Filed: Nov. 22, 1996

[86] PCT No.: PCT/SE96/01526

§ 371 Date: Aug. 14, 1998

§ 102(e) Date: Aug. 14, 1998

[87] PCT Pub. No.: WO97/19458

PCT Pub. Date: Mar. 29, 1997

[30] Foreign Application Priority Data

Nov. 24, 1995 [SE] Sweden ..... 9504204

[51] Int. Cl.[7] ..... H01F 27/25; H01F 27/30; H01F 41/02

[52] U.S. Cl. ..... 336/83; 29/605; 29/606; 336/212; 336/213

[58] Field of Search ..... 336/83, 212, 213, 336/233; 29/605, 606, 609, 602.1

[56] References Cited

U.S. PATENT DOCUMENTS 2,142,066 12/1938 Eppelsheimer .
3,153,214 10/1964 Brutt et al. ..... 336/213
5,092,027 3/1992 Denner .

FOREIGN PATENT DOCUMENTS 563517 8/1944 United Kingdom .

*Primary Examiner*—Thomas J. Kozma
*Attorney, Agent, or Firm*—Burns, Doane, Swecker & Mathis, L.L.P.

[57] ABSTRACT

The invention relates to an inductive component that comprises a magnetic core (1), coil (6) and yoke (7, 10). According to the invention, the magnetic core (1) comprises a cylinder (2) that has been wound from wide strip material around a non-magnetic material (5) such as to obtain planar outer ends (8, 9). Two flanges (3, 4) are wound from two narrow strips at the outer ends (8, 9) of the cylinder. The coil (6) is wound around the centre part of the cylinder (2) between the flanges (3, 4). Finally, the yoke (7, 10) is wound from strip material around the magnet core (1).

11 Claims, 3 Drawing Sheets

INDUCTIVE COMPONENT WITH WOUND CORE

FIELD OF INVENTION

The present invention relates to an inductive component that includes a magnetic core, coil and yoke.

DESCRIPTION OF THE BACKGROUND ART

Magnet cores are manufactured in many different ways. British Patent Specification 563517 teaches a method in which a strip is wound around a cylinder, whereafter the cylinder then is removed and the coiled strip then is compressed. A yoke is formed by winding another strip to a rectangular shape, whereafter the compressed coil is inserted into the yoke. Sintered or punched cores and yokes are examples of other variants. The evenness of the transition areas between the magnetic elements varies markedly, and these areas must therefore be ground or polished to small tolerances at subsequent high costs. Toroidally wound strip is another available alternative, although with limited use and requiring a complicated winding procedure.

SUMMARY OF THE INVENTION

The problem relating to small and varying transition areas for the magnetic flux is solved in accordance with the present invention by using a magnet core in the shape of a dumbbell. The magnet core includes a cylinder comprised of wide strip wound around non-magnetic material, and two flanges wound from two narrower strips edge-to-edge with the planar outer ends of the cylinder. A coil is wound around the centre part of the cylinder, between the flanges. A yoke is wound around the magnet core, so that magnetic flux can return.

One of the advantages afforded by the invention is that it provides large and controllable transition areas for the magnetic flux, while minimizing the influence of the stray air gaps at the same time. The invention also enables flexible and inexpensive transformers and inductors to be constructed with the aid of available winding techniques, with which most existing production equipment and assembling equipment can be used. Robotized manufacturing processes will, of course, be the next stage in the production of such products.

FIGS; 3*a,b,c,* are perspective views of a third embodiment.

DESCRIPTION OF PREFERRED EMBODIMENTS

Figure 1A:
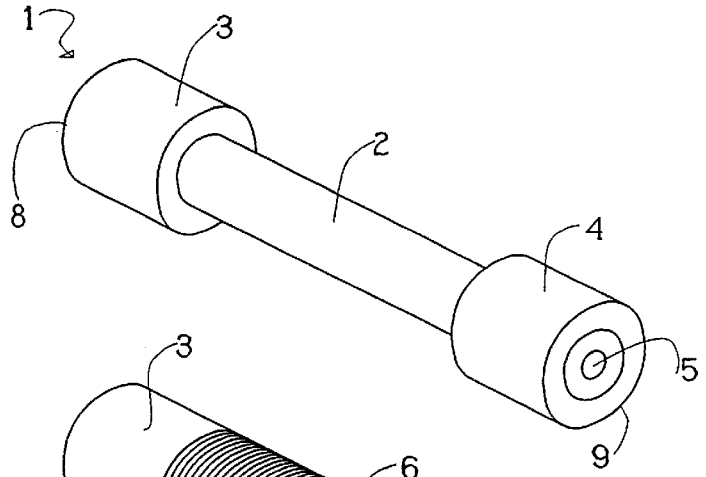
FIGS. 1*a,b,c* are perspective views of one embodiment.
Figure 1B:
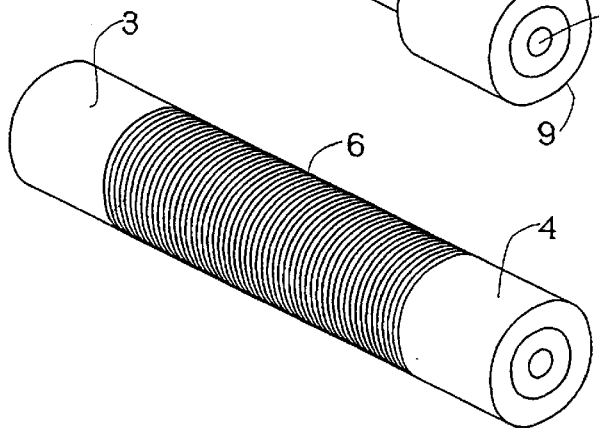
FIG. 1*d* illustrates a variant of this embodiment.
Figure 1C:
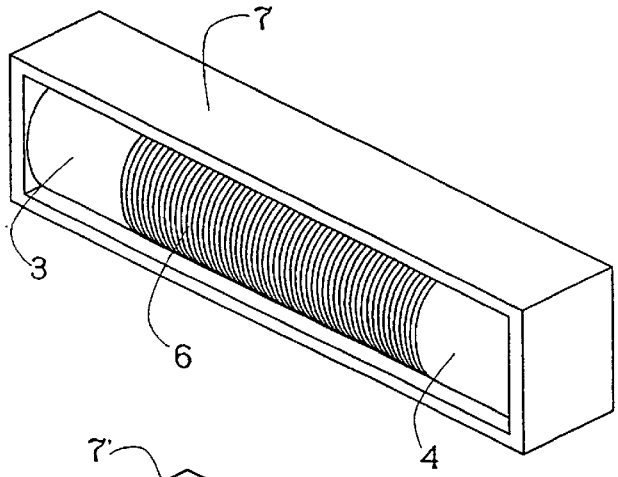

FIGS. 1*a,b,c* illustrate one embodiment of the invention. A dumbbell-shaped magnet core 1 is wound from three strips of ferromagnetic, amorphous material. This type of strip material is used because it has good magnetic properties and results in low losses. A wide strip is first wound around non-magnetic material 5 such as to produce a cylinder 2 that has planar outer ends 8, 9. Two narrower strips are then wound edge-to-edge with the outer ends 8, 9, to provide two flanges 3, 4.

The coil 6 is then wound around the centre part of the cylinder 2 between the flanges 3, 4 a desired number of turns. Finally, a strip is wound around the magnet core in the longitudinal direction thereof and over the outer ends, 8, 9, to form a rectangular yoke 7 for return of the magnetic flux. The strip used to fabricate the yoke 7 is also comprised of ferromagnetic, amorphous material.

Figure 1D:
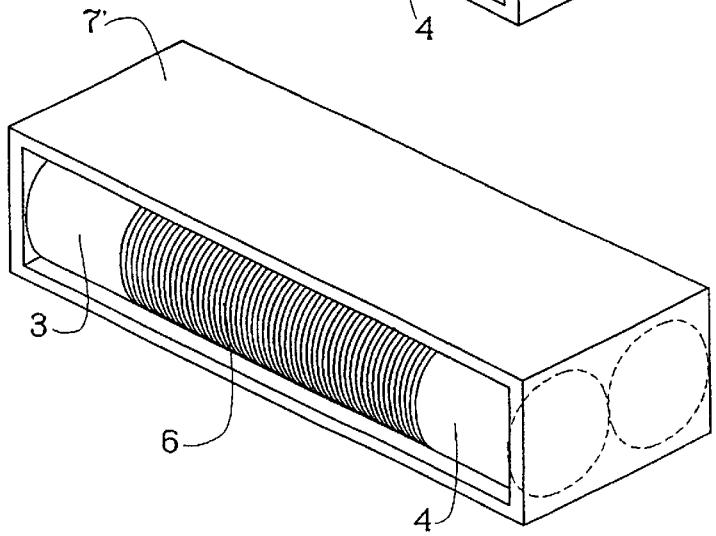

Several inductive components wound in this way can be placed in side-by-side relationship. Alternatively, a common yoke 7' may be wound around two or more magnet cores 1 as illustrated in FIG. 1*d*. The width of the strip from which the yoke 7' is wound will be adapted to the number of magnet cores concerned.

Figure 2A:
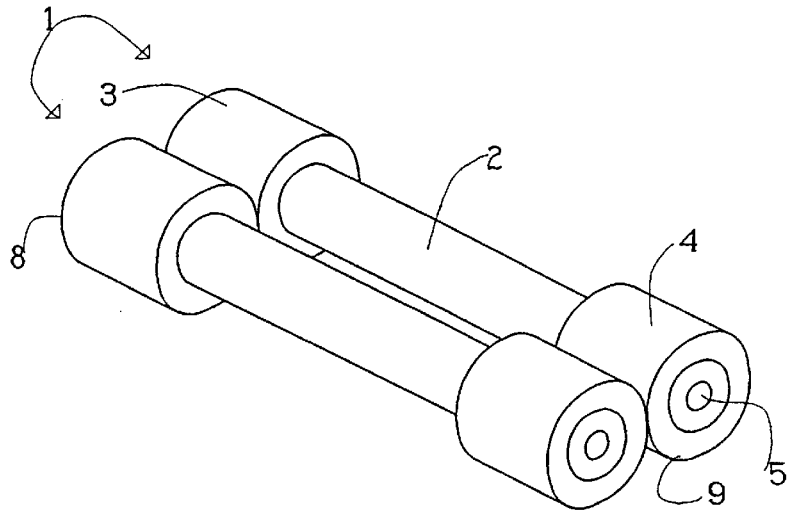
FIGS. 2*a,b,c,* are perspective views of another embodiment.
Figure 2B:
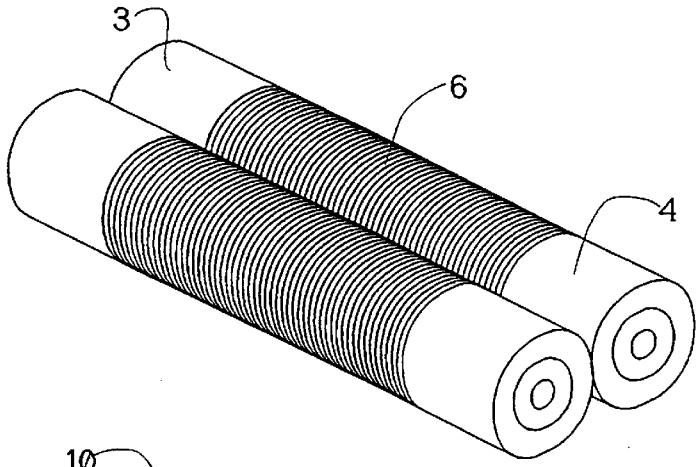
Figure 2C:
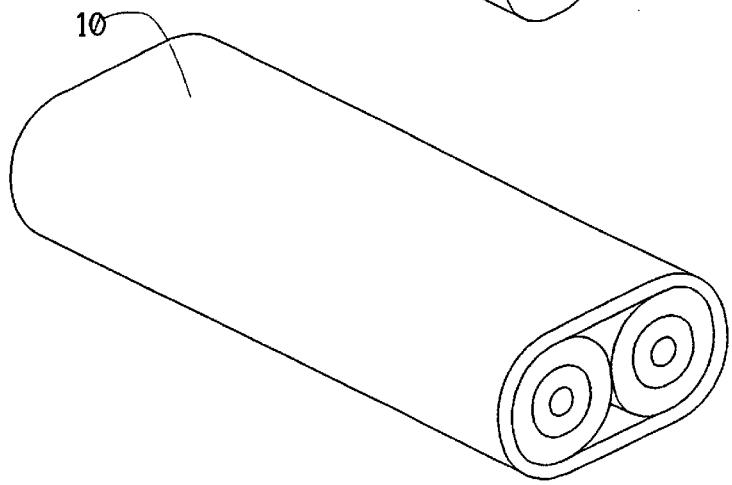

The alternatives afforded by the embodiment illustrated in FIGS. 2*a,b,c* can be used when desiring several magnet cores. In this case, two magnet cores 1 and respective coils 6 can be fabricated in accordance with the aforegoing. The common yoke 10 will have a different configuration than that in the first embodiment, but will be made of the same material. In this case, the yoke 10 has an oval configuration and is comprised of strip material whose width is equal to the width of the strip material used to wind the cylinder 2. The yoke 10 is then wound with strip material disposed edge-to-edge with the outer ends 8, 9.

It will be understood that more than two magnet cores 1 may also be used in this case. On the other hand, when the yoke 10 is used solely in respect of one magnet core 1, it is necessary to provide a hole in the casing for receiving the coil connecting wires. This hole should be made as small as possible, so as to minimize disturbance of the magnetic flux. The first embodiment is thus more advantageous when wishing to use one magnet core.

Figure 3A:
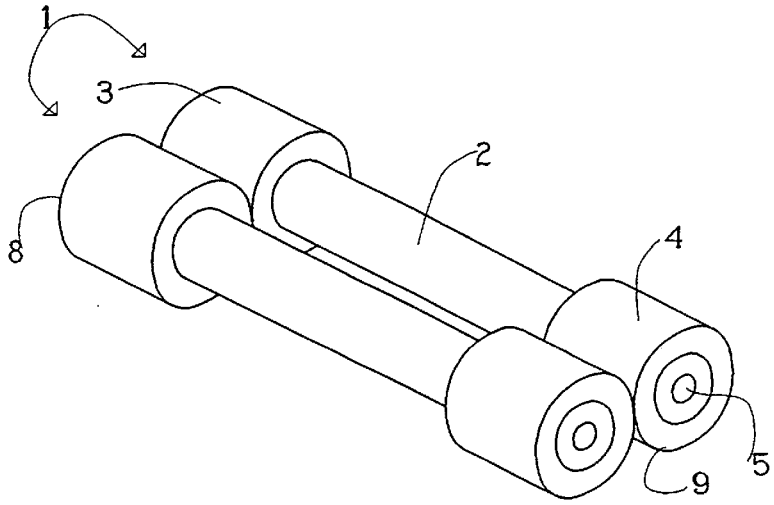
Figure 3B:
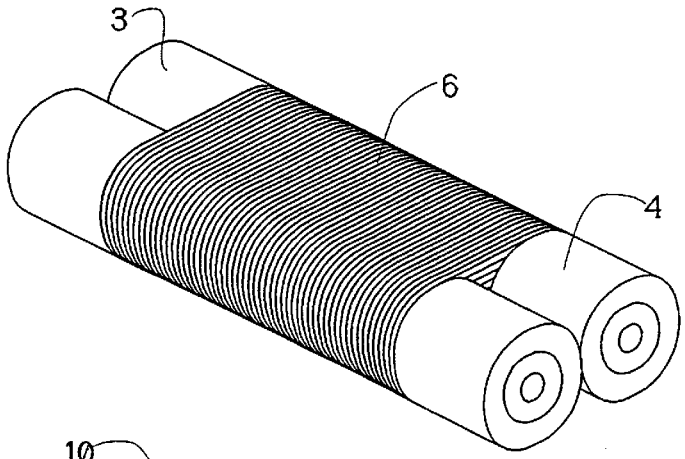
Figure 3C:
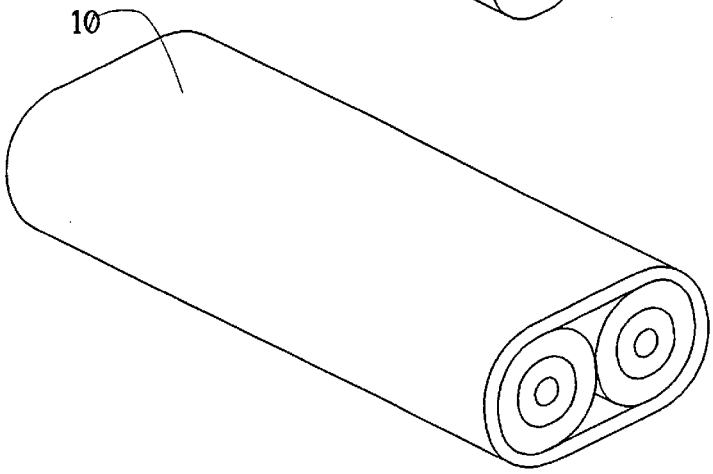

FIGS. 3*a,b,c* illustrate a third embodiment in which the coil 6 is wound commonly around more than one cylinder 2. This variant can be combined with both types of yokes 7, 10.

The non-magnetic material may be copper or plastic material for instance, the only criterion being that the material is non-magnetic. The material, or substance, used may be air, which is after all non-magnetic.

I claim:

1. An inductive component comprising a magnet core (1), a coil (6) and a yoke (7, 10), characterized in that the magnet core (1) includes a cylinder (2) having planar outer ends (8, 9) and being wound from a wide strip of material around non-magnetic material (5), and further comprising two flanges (3, 4) that are wound from two narrower strips of material at the planar outer ends (8, 9) of the cylinder; and in that the coil (6) is wound around the centre part of the cylinder (2) between the flanges (3, 4); and in that the yoke (7, 10) is wound from a strip of material around the magnetic core (1).

2. An inductive component according to claim 1, characterized in that at least two magnetic cores (1) are disposed side-by-side with the flanges (3, 4) in mutual abutment; in that a coil (6) is wound around each cylinder (2); and in that the yoke (7, 10) is common to all magnet cores (1).

3. An inductive component according to claim 1, characterized in that at least two magnet cores (1) are disposed side-by-side with the flanges (3, 4) in mutual abutment; in that one single coil (6) is wound commonly around the cylinders (2); and in that the yoke (7, 10) is common to all magnet cores (1).

4. An inductive component according to claim 1, characterized in that the yoke (10) has an oval shape; and in that the width of the strip from which the yoke (10) is wound is the same as the width of the strip from which the cylinder (2) is wound and in that the yoke is wound edge-to-edge with the planar outer ends (8, 9), wherein the yoke (10) includes a hole, an aperture or the like through which coil connecting wires can be passed.

5. An inductive component according to claim 2, characterized in that the yoke (10) has an oval shape; and in that the width of the strip from which the yoke (10) is wound is the same as the width of the strip from which the cylinder (2) is wound, wherein the yoke is wound edge-to-edge with the planar outer ends (8, 9).

6. An inductive component according to claim 1, characterized in that the yoke (10) has a rectangular shape; and in that the width of the strip from which the yoke (10) is wound is the same as the width of the magnetic core/magnetic cores (1), wherein the yoke (10) is wound parallel with the longitudinal direction of the magnetic core/magnetic cores and over said planar outer ends (8, 9).

7. An inductive component according to claim 6, characterized in that the flanges (3, 4) are wound edge-to-edge with the planar outer ends (8, 9) of the cylinder.

8. An inductive component according to claim 1, characterized in that the strip material is a ferromagnetic, amorphous material.

9. An inductive component according to claim 1, characterized in that the non-magnetic material (5) is plastic or copper.

10. An inductive component according to claim 1, characterized in that the non-magnetic material (5) is air.

11. A method of manufacturing an inductive component that comprises a magnet core (1), a coil (6) and a yoke (7, 10), characterized in that the magnet core (1) is fabricated by winding a wide strip of material around a non-magnetic material (5) to produce a cylinder (2); in that two narrower strips are wound at the outer ends (8, 9) of the cylinder to provide two flanges (3, 4); in that the coil (6) is wound around the centre part of the cylinder (2) between the flanges (3, 4); and in that strip material is wound around the magnet core (1) to provide the yoke (7, 10).

* * * * *